US011434118B2

(12) United States Patent
Zhang et al.

(10) Patent No.: US 11,434,118 B2
(45) Date of Patent: Sep. 6, 2022

(54) PLATEN OF AN AUTOMOBILE ELEVATING DEVICE AND AUTOMOBILE ELEVATOR

(71) Applicant: YINGKOU TIANZHOU TECHNOLOGY CO., LTD., Liaoning (CN)

(72) Inventors: Xiaoguang Zhang, Liaoning (CN); Yuzhu Wang, Liaoning (CN)

(73) Assignee: YINGKOU TIANZHOU TECHNOLOGY CO., LTD., Yingkou (CN)

( * ) Notice: Subject to any disclaimer, the term of this patent is extended or adjusted under 35 U.S.C. 154(b) by 247 days.

(21) Appl. No.: 16/816,159

(22) Filed: Mar. 11, 2020

(65) Prior Publication Data

US 2021/0221662 A1 Jul. 22, 2021

(30) Foreign Application Priority Data

Jan. 20, 2020 (CN) ..... 202020133389.8

(51) Int. Cl.
*B25B 11/00* (2006.01)
*B66F 7/28* (2006.01)

(52) U.S. Cl.
CPC ..... *B66F 7/28* (2013.01)

(58) Field of Classification Search
CPC ..... B66F 7/00; B66F 7/06; B66F 7/08; B66F 7/065; B66F 7/28; B66F 7/0691; B66F 7/0666; B66F 7/243; B66F 7/24
USPC ..... 254/93 L, 93 H, 93 R, 89 R, 91, DIG. 1, 254/DIG. 16; 187/216
See application file for complete search history.

(56) References Cited

U.S. PATENT DOCUMENTS 2,498,086 A * 2/1950 Le Clair ..... B66F 7/18 187/216
2,659,937 A * 11/1953 Hammer ..... B66F 7/28 137/234.6
3,326,525 A * 6/1967 Kauppi ..... B66F 7/243 254/88
3,680,495 A * 8/1972 Pike ..... B65D 19/0018 108/53.3
4,328,993 A * 5/1982 Trotman ..... A47C 7/425 297/452.45

(Continued)

FOREIGN PATENT DOCUMENTS

WO WO-2019096689 A1 * 5/2019 ..... E04H 6/12

*Primary Examiner* — Lee D Wilson
(74) *Attorney, Agent, or Firm* — McCoy Russell LLP

(57) ABSTRACT

The invention relates to an automobile elevating device. A platen of an automobile elevating device comprises a supporting plate, wherein the supporting plate has at least one first folded-back structure passing through front and back end parts; two wing sides of the supporting plate have a reinforcing structure formed by bending side edges of the supporting plate, and the reinforcing structure is located on a bottom surface of the supporting plate, wherein a last segment of the reinforcing structure is a horizontal structure and the last segment of the reinforcing structure abuts against the bottom surface of the supporting plate; two wing sides of the supporting plate have a reinforcing structure formed by bending side edges of the supporting plate, and the reinforcing structure is located on a bottom surface of the supporting plate, and a second folded-back structure is provided on a vertical wall of the reinforcing structure.

20 Claims, 1 Drawing Sheet

(56) References Cited

U.S. PATENT DOCUMENTS

| | | | | |
|---|---|---|---|---|
| 5,507,236 | A * | 4/1996 | Bruno | B65D 19/0028 108/51.11 |
| 2009/0321189 | A1* | 12/2009 | Schmitt | B66F 7/28 187/215 |
| 2012/0000401 | A1* | 1/2012 | Strizki | B65D 19/0095 108/57.22 |
| 2016/0167831 | A1* | 6/2016 | Suiter | B65D 19/0018 108/53.1 |

* cited by examiner

PLATEN OF AN AUTOMOBILE ELEVATING DEVICE AND AUTOMOBILE ELEVATOR

CROSS REFERENCE TO RELATED APPLICATIONS

The present application claims priority to Chinese Patent Application No. 202020133389.8, entitled "PLATEN OF AN AUTOMOBILE ELEVATING DEVICE AND AUTOMOBILE ELEVATOR", and filed on Jan. 20, 2020. The entire contents of the above-listed application is hereby incorporated by reference for all purposes.

FIELD OF THE INVENTION

The invention relates to the field of automobile elevating device, in particular to a platen of an automobile elevating device.

BACKGROUND OF THE INVENTION

An automobile elevator is an important auxiliary device in the field of automobile warranty service and is a basis for automobile repair, maintenance and care. It may lift an automobile to a certain height, so that the tires of the automobile may deviate from the ground, and then, an operator may work on the tires; or the automobile elevator enables an automobile chassis to leave the ground for an enough space, so that the operator may work at the bottom of the automobile. Therefore, the safety of the automobile in a lifting process, and the safety of the automobile in the air after the elevator lifts the automobile to the required height are the most important performance indicator of the automobile elevator. An automobile elevator lifting platform is a carrier for carrying the tires of the automobile, and the weight of the automobile itself acts on the lifting platform through the tires of the automobile, therefore, the stability of the automobile elevator lifting platform is a main criterion for evaluating the performance of the elevator.

The existing automobile elevator lifting platform structure is mainly made by welding square tubes or channel steels on two side edges of a flat plate, wherein the flat plate is used as a platform lifting tabletop, and the square tubes or channel steels are used as side supporting edges. In the lifting platform of this structure, since a supporting plate has a large area, a torque on the periphery of the supporting plate is relatively large when the wheels acts on the lifting supporting plate, resulting in easy distortion of the supporting plate. At the same time, when the side supporting edges of the platform receive the force transmitted from the supporting plate, since the lengths of the side supporting edges are relatively large, the areas of the supporting edges are relatively large, thereby leading to easy bending deformation of the supporting edges. Therefore, how to solve the problem of the distortion of the lifting supporting plate and the strength of the side supporting edges of the supporting plate is an important issue in the automobile elevator industry. At present, in order to improve the strength of the lifting tabletop and the side supporting edges, most of the practice is to increase the thickness of the plate and the thicknesses of the supporting edges, which will undoubtedly increase the loss of raw materials.

SUMMARY OF THE INVENTION

In order to solve the above problems, the invention proposes a platen of an automobile elevating device, which does not increase the loss of raw materials and reduces the torque on the surrounding of a platform tabletop so as to improve the load resistance of the tabletop. The invention further proposes an automobile elevator.

In order to achieve the above objective, the invention adopts the following technical solutions:

In a first technical solution, a platen of an automobile elevating device comprises a supporting plate and one or a combination of the following three features:

the supporting plate has at least one first folded-back structure passing through front and back end parts;

two wing sides of the supporting plate have a reinforcing structure formed by bending side edges of the supporting plate, and the reinforcing structure is located on a bottom surface of the supporting plate, wherein a last segment of the reinforcing structure is a horizontal structure and the last segment of the reinforcing structure abuts against the bottom surface of the supporting plate;

two wing sides of the supporting plate have a reinforcing structure formed by bending side edges of the supporting plate, and the reinforcing structure is located on a bottom surface of the supporting plate, wherein a rectangular section of the reinforcing structure is rectangular or trapezoidal, and a second folded-back structure is provided on a vertical wall of the reinforcing structure.

Preferably, the number of first folded-back structure is at least three.

Preferably, the first folded-back structures are arranged at equal intervals.

Preferably, the first folded-back structure is a groove structure or a projection structure.

Preferably, the first folded-back structure is a groove structure, and a tail end of the reinforcing structure abuts against an outer side wall of the groove structure.

Preferably, the tail end of the reinforcing structure is fixedly connected with the outer side wall of the groove structure by welding.

Preferably, a side edge of the supporting plate is bent downward to form a first edgefold, the first edgefold is vertical to the supporting plate, an edge of the first edgefold away from the supporting plate is vertically bent inward to form a second edgefold, an edge of the second edgefold away from the first edgefold is bent toward the bottom surface of the supporting plate to form a third edgefold, and the tail end of the third edgefold abuts against the bottom surface of the supporting plate.

Preferably, an edge of the third edgefold close to the supporting plate is bent toward a direction away from the first edgefold to form a fourth edgefold, and the surface of the fourth edgefold abuts against the bottom surface of the supporting plate, wherein when the supporting plate has at least one first folded-back structure passing through front and back end parts and the first folded-back structure is a groove structure, the tail end of the fourth edgefold abuts against an outer side wall of the groove of the first folded-back structure.

Preferably, the first edgefold and/or the third edgefold has a second folded-back structure.

Preferably, the second folded-back structure is a groove structure or a projection structure.

In a second technical solution, an automobile elevator uses the platen of an automobile elevating device according to any item in the first technical solution as a component for supporting an automobile.

The beneficial effects of using the invention include:

The platen of an automobile elevating device adopts a design structure of a folded-back supporting plate, and the local stress of the supporting plate is transferred by a bending angle formed by the folded-back structure of the supporting plate to reduce the torque around the supporting plate, thereby improving the load resistance of the tabletop, and increasing no loss of raw materials. At the same time, a folded-back structure is also adopted on the side supporting edge of the supporting plate, and the tail end of an extension surface of the supporting edge abuts against the bending angle of the folded-back structure of the supporting plate, thereby improving the stability of the side supporting edge and increasing plate length and load length.

REFERENCE SIGNS

10—supporting plate, 11—first folded—back structure, 20—reinforcing structure, 21—first edgefold, 22—second edgefold, 23—third edgefold, 24—four edgefold, 30—second folded—back structure.

DETAILED DESCRIPTION OF THE EMBODIMENTS

In order to make the objectives, technical solutions and advantages of the technical solutions be clearer, the technical solutions are further described in detail below in conjunction with the specific embodiments. It should be understood that these descriptions are only exemplary and are not intended to limit the scope of the technical solutions.

Embodiment 1

Figure 1:
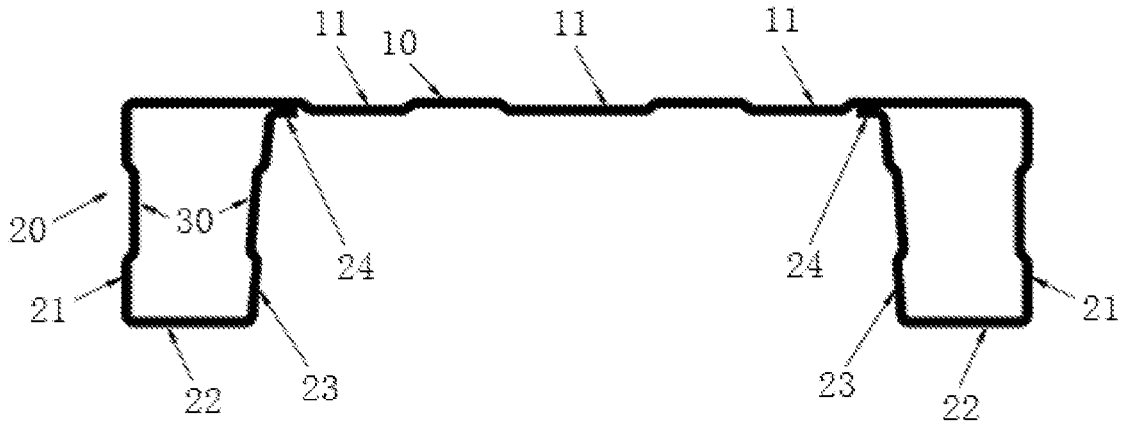
FIG. 1 is a structural schematic diagram of a platen of an automobile elevating device in the invention.
Figure 2:
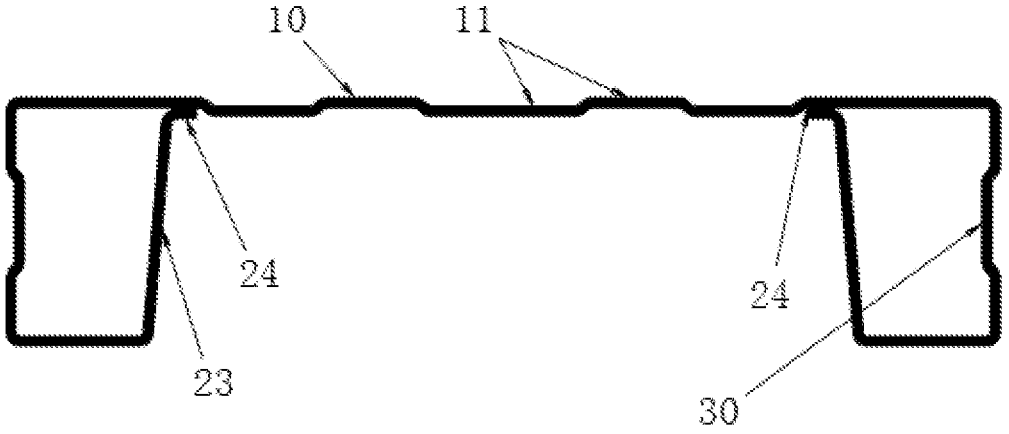
FIG. 2 is another structural schematic diagram of a platen of an automobile elevating device in the invention.

As shown in FIG. 1 and FIG. 2, a platen of an automobile elevating device proposed by the present embodiment comprises a supporting plate 10, and the supporting plate 10 has at least one first folded-back structure 11 passing through front and rear end parts; and/or, two wing sides of the supporting plate 10 have a reinforcing structure 20 formed by bending side edges of the supporting plate 10, and the reinforcing structure 20 is located on a bottom surface of the supporting plate 10.

Specifically, in this embodiment, the number of first folded-back structure 11 is at least three and the first folded-back structures 11 are arranged at equal intervals.

The first folded-back structure 11 is a groove structure or a projection structure. In the present embodiment, the first folded-back structure 11 is a groove, and the first folded-back structure 11 may enhance the mechanical properties of the supporting plate 10.

A last segment of the reinforcing structure 20 is a horizontal structure, and the last segment of the reinforcing structure 20 abuts against the bottom surface of the supporting plate 10 to enhance the stability of the supporting plate 10.

The first folded-back structure 11 is a groove structure, and a tail end of the reinforcing structure 20 abuts against an outer side wall of the groove structure.

A longitudinal section of the reinforcing structure 20 is rectangular or trapezoidal, and the reinforcing structure 20 of such a structure has strong supporting ability.

As shown in FIG. 1, a side edge of the supporting plate 10 is bent downward to form a first edgefold 21, the first edgefold 21 is vertical to the supporting plate 10, an edge of the first edgefold 21 away from the supporting plate 10 is vertically bent inward to form a second edgefold 22, an edge of the second edgefold 22 away from the first edgefold 21 is bent toward the bottom surface of the supporting plate 10 to form a third edgefold 23, and the tail end of the third edgefold 23 abuts against the bottom surface of the supporting plate 10.

Preferably, an edge of the third edgefold 23 close to the supporting plate 10 is bent toward a direction away from the first edgefold 21 to form a fourth edgefold 24, the surface of the fourth edgefold 24 abuts against the bottom surface of the supporting plate 10, and the joints of the fourth edgefold 24 and the bottom surface of the supporting plate 10 are fixed by welding. An edge of the third edgefold 23 close to the supporting plate 10 is bent toward a direction away from the first edgefold 21 to form a fourth edgefold 24, and the surface of the fourth edgefold 24 abuts against the bottom surface of the supporting plate 10. When the supporting plate 10 has at least one first folded-back structure 11 passing through front and back end parts and the first folded-back structure 11 is a groove structure, the tail end of the fourth edgefold 24 abuts against an outer side wall of the groove of the first folded-back structure.

The first edgefold 21 and the third edgefold 23 have second folded-back structures 30. The second folded-back structure 30 is a groove structure or a projection structure. The number and shape of the second folded-back structures 30 are not limited, and the position of the first folded-back structure 11 and all side edges or a part of side edges have folded-back structures.

The invention adopts a folded-back design structure, the folded-back structures (including the first folded-back structure 11 and the second folded-back structure 30) are processed on the supporting plate 10 and the side of the supporting plate 10 in a fold-back manner, and these folded-back structures divide the surfaces of the supporting plate 10 and the side supporting edge with relatively large surface areas into local planes with relatively small areas. When the pressure of wheels acts on the supporting plate 10, the supporting plate 10 decomposes and transfers the force acting on the supporting plate 10 by the folded-back structures formed by these folded-back structures. The torque at a distal end position of a stress acting point of the supporting plate 10 is reduced to prevent the distal end of the stress acting point of the supporting plate 10 from being twisted or deformed due to the excessive torque, thereby achieving the purpose of enhancing the strength of the upright post tabletop. This method is to enhance the strength of the supporting plate 10 by changing the design structure of the supporting plate 10, thereby causing no waste to raw materials.

Based on the same principle, the side supporting edge of the platform also has a folded-back structure, the principle of which is the same as that of the folded-back structure acting on the supporting plate 10, and thus will not be described repeatedly herein.

In addition, the side supporting edge of the lifting supporting plate 10 of the invention is folded back into a small plane at the tail end edge, and the fourth edgefold 24 is located in the groove formed when the supporting plate 10 is folded back, thereby playing a certain supporting role on the supporting plate 10. The edge of the fourth edgefold 24 abuts against the side edge of the first folded-back structure 11 of the supporting plate 10, so that the supporting edge can be prevented from moving laterally along the bottom of the supporting plate 10, and the strength and stability of the side supporting edge are further improved.

Example 2

An automobile elevator uses a platen of an automobile elevating device of any item in embodiments 1 as a component for supporting an automobile.

The above contents are merely preferred embodiments of the invention, and for those of ordinary skill in the art, many changes may be made to the specific embodiments and application ranges according to the idea of the technical contents, and as long as these changes do not deviate from the concept of the invention, they all fall within the protection scope of the present patent.

The invention claimed is:

1. A platen of an automobile elevating device, wherein the platen comprises a supporting plate, wherein the supporting plate has at least one first folded-back structure passing through front and back end parts, wherein two wing sides of the supporting plate have a reinforcing structure formed by bending side edges of the supporting plate, and the reinforcing structure is located on a bottom surface of the supporting plate, wherein a last segment of the reinforcing structure is a horizontal structure and the last segment of the reinforcing structure abuts against the bottom surface of the supporting plate, wherein the reinforcing structure is rectangular or trapezoidal, and a second folded-back structure is provided on a vertical wall of the reinforcing structure.

2. The platen of an automobile elevating device according to claim 1, wherein the number of first folded-back structure is at least three.

3. The platen of an automobile elevating device according to claim 2, wherein the first folded-back structure is arranged at equal intervals.

4. The platen of an automobile elevating device according to claim 1, wherein the first folded-back structure is a groove structure or a projection structure.

5. The platen of an automobile elevating device according to claim 4, wherein the first folded-back structure is a groove structure, and a tail end of the reinforcing structure abuts against an outer side wall of the groove structure.

6. The platen of an automobile elevating device according to claim 5, wherein the tail end of the reinforcing structure is fixedly connected with the outer side wall of the groove structure by welding.

7. The platen of an automobile elevating device according to claim 6, wherein a side edge of the supporting plate is bent downward to form a first edgefold, the first edgefold is vertical to the supporting plate, an edge of the first edgefold away from the supporting plate is bent inward to form a horizontal second edgefold vertical to the first edgefold, an edge of the second edgefold away from the first edgefold is bent toward the bottom surface of the supporting plate to form a third edgefold, and the tail end of the third edgefold abuts against the bottom surface of the supporting plate.

8. The platen of an automobile elevating device according to claim 7, wherein an edge of the third edgefold close to the supporting plate is bent toward a direction away from the first edgefold to form a fourth edgefold, and the surface of the fourth edgefold abuts against the bottom surface of the supporting plate, wherein when the supporting plate has at least one first folded-back structure passing through front and back end parts and the first folded-back structure is a groove structure, the tail end of the fourth edgefold abuts against an outer side wall of the groove of the first folded-back structure.

9. The platen of an automobile elevating device according to claim 7, wherein the first edgefold and/or the third edgefold has a second folded-back structure.

10. The platen of an automobile elevating device according to claim 7, wherein the second folded-back structure is a groove structure or a projection structure.

11. An automobile elevator, wherein a platen of an automobile elevating device is used as a component for supporting an automobile, wherein the platen comprises a supporting plate, wherein the supporting plate has at least one first folded-back structure passing through front and back end parts, wherein two wing sides of the supporting plate have a reinforcing structure formed by bending side edges of the supporting plate, and the reinforcing structure is located on a bottom surface of the supporting plate, wherein a last segment of the reinforcing structure is a horizontal structure and the last segment of the reinforcing structure abuts against the bottom surface of the supporting plate, wherein the reinforcing structure is rectangular or trapezoidal, and a second folded-back structure is provided on a vertical wall of the reinforcing structure.

12. The automobile elevator according to claim 11, wherein the number of first folded-back structure is at least three.

13. The automobile elevator according to claim 12, wherein the first folded-back structure is arranged at equal intervals.

14. The automobile elevator according to claim 11, wherein the first folded-back structure is a groove structure or a projection structure.

15. The automobile elevator according to claim 14, wherein the first folded-back structure is a groove structure, and a tail end of the reinforcing structure abuts against an outer side wall of the groove structure.

16. The automobile elevator according to claim 15, wherein the tail end of the reinforcing structure is fixedly connected with the outer side wall of the groove structure by welding.

17. The automobile elevator according to claim 16, wherein a side edge of the supporting plate is bent downward to form a first edgefold, the first edgefold is vertical to the supporting plate, an edge of the first edgefold away from the supporting plate is bent inward to form a horizontal second edgefold vertical to the first edgefold, an edge of the second edgefold away from the first edgefold is bent toward the bottom surface of the supporting plate to form a third edgefold, and the tail end of the third edgefold abuts against the bottom surface of the supporting plate.

18. The automobile elevator according to claim 17, wherein an edge of the third edgefold close to the supporting plate is bent toward a direction away from the first edgefold to form a fourth edgefold, and the surface of the fourth edgefold abuts against the bottom surface of the supporting plate, wherein when the supporting plate has at least one first folded-back structure passing through front and back end parts and the first folded-back structure is a groove structure, the tail end of the fourth edgefold abuts against an outer side wall of the groove of the first folded-back structure.

19. The automobile elevator according to claim 17, wherein the first edgefold and/or the third edgefold has a second folded-back structure.

20. The automobile elevator according to claim 17, wherein the second folded-back structure is a groove structure or a projection structure.

* * * * *